US009754736B2

(12) United States Patent
Wang et al.

(10) Patent No.: US 9,754,736 B2
(45) Date of Patent: Sep. 5, 2017

(54) MOTOR CAM OPERATING MECHANISM AND TRANSMISSION MECHANISM THEREOF

(71) Applicants: SEARI ELECTRIC TECHNOLOGY CO., LTD., Shanghai (CN); ZHEJIANG CHINT ELECTRICS CO., LTD., Yueqing (CN)

(72) Inventors: Bo Wang, Shanghai (CN); Jinyu Zhou, Shanghai (CN); Degang Qu, Shanghai (CN); Xiaopeng Jiang, Shanghai (CN); Jiajun Lu, Shanghai (CN)

(73) Assignees: SEARI ELECTRIC TECHNOLOGY CO., LTD., Shanghai (CN); ZHEJIANG CHINT ELECTRICS CO., LTD., Yueqing (CN)

( * ) Notice: Subject to any disclaimer, the term of this patent is extended or adjusted under 35 U.S.C. 154(b) by 0 days.

(21) Appl. No.: 15/103,352

(22) PCT Filed: Oct. 24, 2014

(86) PCT No.: PCT/CN2014/089372
§ 371 (c)(1),
(2) Date: Jun. 10, 2016

(87) PCT Pub. No.: WO2015/085832
PCT Pub. Date: Jun. 18, 2015

(65) Prior Publication Data

US 2016/0307711 A1 Oct. 20, 2016

(30) Foreign Application Priority Data

Dec. 13, 2013 (CN) ..... 2013 1 0686608

(51) Int. Cl.
*H01H 3/26* (2006.01)
*H01H 3/42* (2006.01)
(Continued)

(52) U.S. Cl.
CPC ..... *H01H 3/26* (2013.01); *H01H 3/30* (2013.01); *H01H 3/3052* (2013.01); *H01H 3/42* (2013.01); *H01H 3/3015* (2013.01); *H01H 9/26* (2013.01)

(58) Field of Classification Search
CPC ..... H01H 3/42; H01H 3/30; H01H 3/3052; H01H 3/26; H01H 9/26; H01H 3/3015
See application file for complete search history.

(56) References Cited

U.S. PATENT DOCUMENTS 3,742,403 A * 6/1973 Nicol ..... H01H 71/465 335/13
6,320,143 B1 11/2001 Greer
(Continued)

FOREIGN PATENT DOCUMENTS

CN 2891243 Y 4/2007
CN 2911920 Y 6/2007
CN 203325761 U 12/2013

OTHER PUBLICATIONS

International Search Report issued in corresponding application No. PCT/CN2014/089372 mailed Jan. 30, 2015 (4 pages).
(Continued)

*Primary Examiner* — Bernard Rojas
(74) *Attorney, Agent, or Firm* — Osha Liang LLP

(57) ABSTRACT

A transmission mechanism includes a link lever, a fan-shaped lever, a spring mechanism and a thrust shaft pin. An outer end of the link lever includes a pin hole and an inner end includes a chute. A cam shaft pin passes through the chute and moves in the chute to drive the link lever when a motor cam rotates. A roller is mounted between the pin hole and the chute. The fan-shaped lever is connected to a main shaft and includes a first chute. The top of the spring mechanism includes a hole. The thrust shaft pin passes through second chutes on two side plates, the first chute, the
(Continued)

hole, and the pin hole and links the link lever, the fan-shaped lever and the spring mechanism. The thrust shaft pin compresses the spring mechanism to store energy and drives the fan-shaped lever to rotate and a contact to move.

10 Claims, 7 Drawing Sheets

(51) Int. Cl.
*H01H 9/26* (2006.01)
*H01H 3/30* (2006.01)

(56) References Cited

U.S. PATENT DOCUMENTS

| | | | |
|---|---|---|---|
| 6,815,624 | B2 | 11/2004 | Schultz |
| 2003/0184421 | A1 | 10/2003 | Schultz |

OTHER PUBLICATIONS

Written Opinion of the International Searching Authority issued in corresponding application No. PCT/CN2014/089372 mailed Jan. 30, 2015 (3 pages).
Office Action issued in corresponding Chinese application No. 201310686608.X dated May 4, 2016 (5 pages).

* cited by examiner

MOTOR CAM OPERATING MECHANISM AND TRANSMISSION MECHANISM THEREOF

BACKGROUND OF THE INVENTION

1. Field of the Invention

The present invention relates to low voltage electrical apparatus, more particularly, relates to motor cam operating mechanism for switch electrical apparatus and transmission mechanism thereof.

2. The Related Art

Switch electrical apparatus is adapted for transmission between a common power supply and a reserve power supply in important power supply situations. An operating mechanism is an important component of a switch electrical apparatus, the operating mechanism performs the transmission between the common power supply and the reserve power supply. In existing products, the operating mechanisms of switch electrical apparatus are categorized into motor driven type and electromagnet driven type. The motor driven type has large torque, but the transmission time is long and the mechanism is complex. The electromagnet driven type acts quickly, but the output force is limited. Further, when the electromagnet driven type operating mechanism acts, a contact will follow the operating mechanism to move.

For example, the Chinese patent application with the application number CN200610053020.0, which is entitled "Automatic switch electrical apparatus", discloses an automatic switch electrical apparatus comprising: a housing on which a load wiring terminal, a first power terminal and a second power terminal are arranged; an automatic switch mechanism arranged inside the housing, the automatic switch mechanism comprising a first movable contactor operated with the first power terminal, a second movable contactor operated with the second power terminal; wherein the first movable contactor and the second movable contactor are electrically connected with the load wiring terminal. The automatic switch mechanism further comprises a mounting plate on which a first movable contact transmission mechanism and the second movable contactor transmission mechanism are mounted.

The Chinese patent application with the application number CN201010017172.1, which is entitled "Transmission mechanism of switch electrical apparatus", discloses a transmission mechanism of switch electrical apparatus, which belongs to the technical field of low-voltage switch equipment and control equipment. The invention is provided with a transmission mechanism composed of a motor device, a V-shaped wheel and drive parts connected between two jaw parts of the V-shaped wheel and respective contact terminals. When in use, the motor device is fastened in the switch electrical apparatus, both ends of a main shaft are fixed in shaft bases of the switch electrical apparatus. The motor rotates forward and backward to drive the transfer mechanism so that two sets of movable contact terminals of TSE are closed or opened, thus the TSE transfers among three operating positions.

The Chinese patent application with the application number CN201110099615.0, which is entitled "Switch electrical apparatus", discloses a switch electrical apparatus comprising: a base, wherein the base is respectively provided with a driving motor and two switch bodies which are stacked up and down, each switch body is connected with a gear transmission mechanism, each gear transmission mechanism comprises a support fixedly arranged on the switch body, a resetting gear assembly, a switch gear and a sector gear, the resetting gear assembly comprises a resetting gear and a resetting spring, the two ends of the resetting spring are respectively connected with the resetting gear and the support, the sector gear is connected with the driving motor, the switch gear is respectively meshed with the teeth of the resetting gear and the teeth of the sector gear; and the sector gears of another two gear transmission mechanisms are coaxially pivoted and the teeth of the two sector gears are arranged back to back.

Generally speaking, existing motor driven type operating mechanisms have complex structures and require high machining precision. For electromagnet driven type operating mechanisms, though their structures are simple, but the electromagnet output force is limited. Further, a contact will follow the operating mechanism to move during an energy storing phase of the mechanism.

SUMMARY

The present invention discloses an operating mechanism with simple structure and reliable transmission, the operating mechanism is adapted for switch electrical apparatus.

According to an embodiment of the present invention, a transmission mechanism of a motor cam operating mechanism is disclosed. The transmission mechanism is in coordination with a cam driven by a motor and is arranged on one side of the cam, the transmission mechanism and the cam are both mounted between two side plates. The transmission mechanism comprises a link lever, a fan-shaped lever, a spring mechanism and a thrust shaft pin. An outer end of the link lever is provided with a pin hole and an inner end of the link lever is provided with a chute. A cam shaft pin passes through the chute and is fastened on the cam. When the cam rotates, the cam shaft pin moves in the chute. When the cam shaft pin contacts with an end of the chute, the cam drives the link lever to move through the cam shaft pin. A roller is mounted between the pin hole and the chute. The fan-shaped lever is mounted on the two side plates via a main shaft and an auxiliary shaft, the fan-shaped lever is provided with a first chute. The bottom of the spring mechanism is rotatably mounted on the side plate and the top of the spring mechanism is provided with a hole. The thrust shaft pin passes through second chutes on two side plates, the first chute on the fan-shaped lever, the hole on the top of the spring mechanism, and the pin hole on the outer end of the link lever, the thrust shaft pin makes linkage of the link lever, the fan-shaped lever and the spring mechanism. When the cam rotates, the cam drives the thrust shaft pin to compress the spring mechanism via the link lever so that the spring mechanism stores energy. In an energy storing phase of the spring mechanism, the thrust shaft pin moves in the first chute of the fan-shaped lever, there is no interaction between the thrust shaft pin and the fan-shaped lever, the fan-shaped lever remains stationary and a contact remains stationary. In an energy releasing phase of the spring mechanism, the thrust shaft pin moves to an end of the first chute and interacts with the fan-shaped lever, the fan-shaped lever rotates and drives the contact to move via the main shaft.

According to an embodiment, the spring mechanism comprises a spring guide rod, an upper bracket a lower bracket and a spring. The bottom of the spring guide rod is provided with a hole and the spring guide rod is rotatably mounted on the side plate, the top of the spring guide rod is provided with a chute. The upper bracket is mounted in the chute on the top of the spring guide rod and moves in the chute, the top of the upper bracket is provided with a hole for the thrust shaft pin to pass through. The lower bracket is mounted on the bottom of the spring guide rod. The spring is installed on the spring guide rod and between the upper bracket and the lower bracket.

According to an embodiment, the fan-shaped lever comprises two fan-shaped plates and a connection portion connecting the two fan-shaped plates. The two fan-shaped plates are identical. Each fan-shaped plate is positioned close to a side plate respectively, wherein one fan-shaped plate is rotatably mounted on one side plate through the main shaft while the other fan-shaped plate is rotatably mounted on the other side plate through the auxiliary shaft. The bottom of each fan-shaped plate is provided with a fan-shaped expansion area, and the first chute is provided in the fan-shaped expansion area.

According to an embodiment of the present invention, a motor cam operating mechanism is disclosed. The motor cam operating mechanism comprises a cam, a common side transmission mechanism and a reserve side transmission mechanism. The cam, the common side transmission mechanism and the reserve side transmission mechanism are mounted between two side plates. The common side transmission mechanism and the reserve side mechanism are the transmission mechanism mentioned above, the common side transmission mechanism and the reserve side transmission mechanism are arranged on both sides of the cam in a symmetrical manner. The cam is mounted on an output shaft of a motor, the motor drives the cam to rotate clockwise or counterclockwise. When operating a common side power supply, the rotation range of the cam is biased towards the reserve side. During a closing procedure, the cam drives the fan-shaped lever through the link lever and cause the fan-shaped lever to rotate from a position deviated outwards from the vertical position to the vertical position, and further to a position deviated inwards from the vertical position, so as to perform an energy storing procedure and an energy releasing procedure. During an opening procedure, the cam drives the fan-shaped lever through the link lever and cause the fan-shaped lever to rotate from a position deviated inwards from the vertical position to the vertical position, and further to a position deviated outwards from the vertical position, so as to perform an energy storing procedure and an energy releasing procedure. When operating a reserve side power supply, the rotation range of the cam is biased towards the common side. During a closing procedure, the cam drives the fan-shaped lever through the link lever and cause the fan-shaped lever to rotate from a position deviated outwards from the vertical position to the vertical position, and further to a position deviated inwards from the vertical position, so as to perform an energy storing procedure and an energy releasing procedure. During an opening procedure, the cam drives the fan-shaped lever through the link lever and cause the fan-shaped lever to rotate from a position deviated inwards from the vertical position to the vertical position, and further to a position deviated outwards from the vertical position, so as to perform an energy storing procedure and an energy releasing procedure.

According to an embodiment, the cam comprises a shaft portion and a fan-shaped portion, the shaft portion is provided with a shaft hole, the output shaft of the motor is installed in the shaft hole, the cam shaft pin is fastened on the fan-shaped portion. The roller is assembled on the link lever through a roller pin.

According to an embodiment of the present invention, a transmission mechanism of a motor cam operating mechanism is disclosed. The transmission mechanism is in coordination with a cam driven by a motor and is arranged on one side of the cam. The transmission mechanism comprises a link lever, a fan-shaped lever, a spring mechanism and a thrust shaft pin. An outer end of the link lever is provided with a pin hole and an inner end of the link lever is provided with a chute. A cam shaft pin passes through the chute and is fastened on the cam. When the cam rotates, the cam shaft pin moves in the chute. When the cam shaft pin contacts with an end of the chute, the cam drives the link lever to move through the cam shaft pin. A roller is mounted between the pin hole and the chute. The fan-shaped lever is rotatably mounted on a main shaft, the fan-shaped lever is provided with a first chute. The bottom of the spring mechanism is rotatably mounted on a rotation shaft and the top of the spring mechanism is provided with a hole. The thrust shaft pin passes through the first chute on the fan-shaped lever, the hole on the top of the spring mechanism, and the pin hole on the outer end of the link lever, the thrust shaft pin makes linkage of the link lever, the fan-shaped lever and the spring mechanism. When the cam rotates, the cam drives the thrust shaft pin to compress the spring mechanism via the link lever so that the spring mechanism stores energy. In an energy storing phase of the spring mechanism, the thrust shaft pin moves in the first chute of the fan-shaped lever, there is no interaction between the thrust shaft pin and the fan-shaped lever, the fan-shaped lever remains stationary and a contact remains stationary. In an energy releasing phase of the spring mechanism, the thrust shaft pin moves to an end of the first chute and interacts with the fan-shaped lever, the fan-shaped lever rotates and drives the contact to move via the main shaft.

According to an embodiment, the spring mechanism comprises a spring guide rod, an upper bracket a lower bracket and a spring. The bottom of the spring guide rod is rotatably mounted on a shaft, the top of the spring guide rod is provided with a chute. The upper bracket is mounted in the chute on the top of the spring guide rod and moves in the chute, the top of the upper bracket is provided with a hole for the thrust shaft pin to pass through. The lower bracket is mounted on the bottom of the spring guide rod. The spring is installed on the spring guide rod and between the upper bracket and the lower bracket.

According to an embodiment, the bottom of each fan-shaped plate is provided with a fan-shaped expansion area, and the first chute is provided in the fan-shaped expansion area.

According to an embodiment of the present invention, a motor cam operating mechanism is disclosed. The motor cam operating mechanism comprises a cam, a common side transmission mechanism and a reserve side transmission mechanism. The common side transmission mechanism and the reserve side mechanism are the transmission mechanism mentioned above. The common side transmission mechanism and the reserve side transmission mechanism are arranged on both sides of the cam in a symmetrical manner. The cam is mounted on an output shaft of a motor, the motor drives the cam to rotate clockwise or counterclockwise. When operating a common side power supply, the rotation range of the cam is biased towards the reserve side. During a closing procedure, the cam drives the fan-shaped lever through the link lever and cause the fan-shaped lever to rotate from a position deviated outwards from the vertical position to the vertical position, and further to a position deviated inwards from the vertical position, so as to perform an energy storing procedure and an energy releasing procedure. During an opening procedure, the cam drives the fan-shaped lever through the link lever and cause the fan-shaped lever to rotate from a position deviated inwards from the vertical position to the vertical position, and further to a position deviated outwards from the vertical position, so as to perform an energy storing procedure and an energy releasing procedure. When operating a reserve side power supply, the rotation range of the cam is biased towards the common side. During a closing procedure, the cam drives the fan-shaped lever through the link lever and cause the fan-shaped lever to rotate from a position deviated outwards from the vertical position to the vertical position, and further to a position deviated inwards from the vertical position, so as to perform an energy storing procedure and an energy releasing procedure. During an opening procedure, the cam drives the fan-shaped lever through the link lever and cause the fan-shaped lever to rotate from a position deviated inwards from the vertical position to the vertical position, and further to a position deviated outwards from the vertical position, so as to perform an energy storing procedure and an energy releasing procedure.

According to an embodiment, the cam comprises a shaft portion and a fan-shaped portion, the shaft portion is provided with a shaft hole, the output shaft of the motor is installed in the shaft hole, the cam shaft pin is fastened on the fan-shaped portion. The roller is assembled on the link lever through a roller pin.

The present invention may realize a transmission between a common side power supply and a reserve side power supply of a switch electrical apparatus by a structure which is relatively simple and easy to manufacture. The mechanism is driven by a motor so that larger contact pressure may be provided and better reliability on mechanical transmission is ensured.

BRIEF DESCRIPTION OF THE DRAWINGS

The above and other features, natures, and advantages of the invention will be apparent by the following description of the embodiments incorporating the drawings, wherein.

DETAILED DESCRIPTION OF EMBODIMENTS

Referring to FIG. 1 to FIG. 8, a motor cam operating mechanism according to a first embodiment of the present invention is disclosed.

Figure 1:
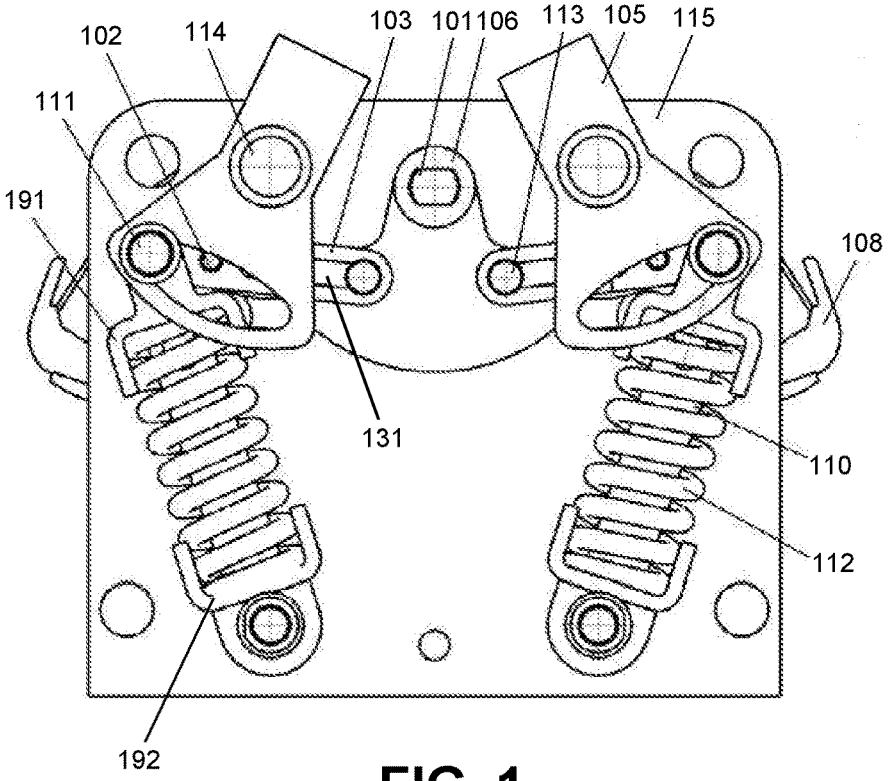
FIG. 1 illustrates a front view of a motor cam operating mechanism according to a first embodiment of the present invention.
Figure 2:
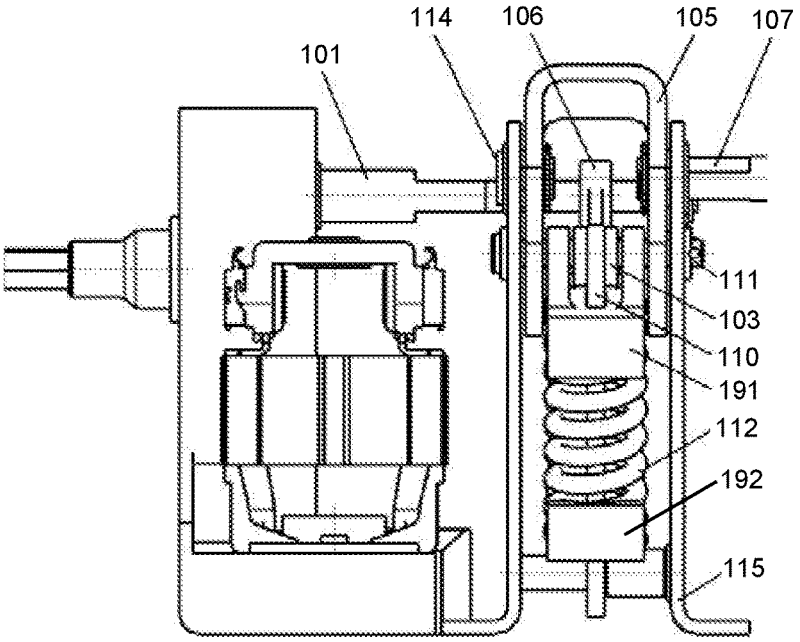
FIG. 2 illustrates a side view of a motor cam operating mechanism according to a first embodiment of the present invention.
Figure 7:
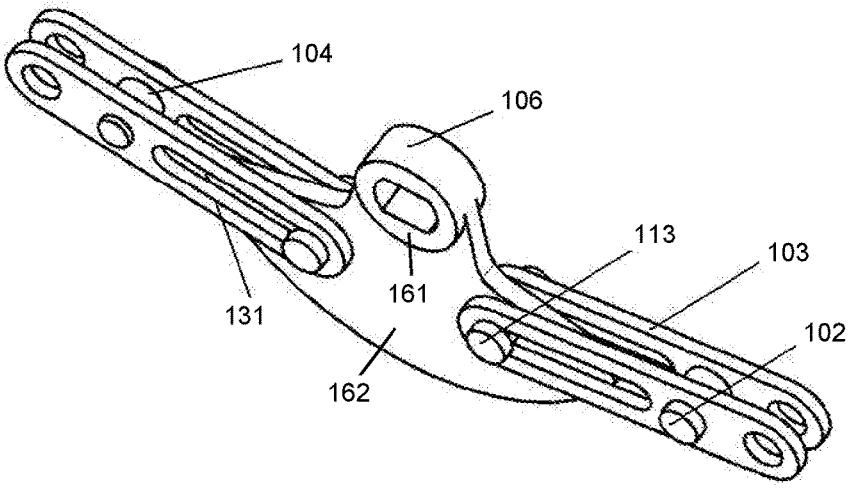
FIG. 7 illustrates a schematic view of installation of a cam and a link lever in a motor cam operating mechanism according to a first embodiment of the present invention.

FIG. 1 illustrates a front view of a motor cam operating mechanism according to a first embodiment of the present invention. FIG. 2 illustrates a side view of a motor cam operating mechanism according to a first embodiment of the present invention. As shown in the figures, the motor cam operating mechanism comprises a cam 106, a common side transmission mechanism and a reserve side transmission mechanism. The cam 106, the common side transmission mechanism and the reserve side transmission mechanism are mounted between two side plates 115. The common side transmission mechanism and the reserve side transmission mechanism have a same structure. The common side transmission mechanism and the reserve side transmission mechanism are arranged on both sides of the cam 106 in a symmetrical manner. The cam 106 is mounted on an output shaft 101 of a motor. The motor drives the cam 106 to rotate clockwise or counterclockwise. According to the embodiment shown in the figures, the cam 106 rotates counterclockwise from a middle position and then the cam 106 deviates towards the reserve side, the cam 106 rotates clockwise from a middle position and the cam 106 deviates towards the common side. Generally, the rotation range of the cam 106 will be limited in one side of the middle position. For example, the cam 106 rotates counterclockwise from the middle position to the most right position shown in the figures to perform a common side closing operation. The cam 106 rotates clockwise from the most right position shown in the figures to the middle position to perform a common side opening operation. Similarly, the cam 106 rotates counterclockwise from the middle position to the most left position shown in the figures to perform a reserve side closing operation. The cam 106 rotates clockwise from the most left position shown in the figures to the middle position to perform a reserve side opening operation. As shown in FIG. 7, the cam 106 comprises a shaft portion 161 and a fan-shaped portion 162. The shaft portion 161 is provided with a shaft hole, the output shaft 101 of the motor is installed in the shaft hole.

As shown in FIG. 1 and FIG. 2, the common side transmission mechanism and the reserve side transmission mechanism have a same structure and are arranged symmetrically. The transmission mechanism is arranged on one side of the cam, the transmission mechanism and the cam are both mounted between two side plates. The transmission mechanism comprises a link lever 103, a fan-shaped lever 105, a spring mechanism and a thrust shaft pin 111.

As shown in FIG. 7, an outer end of the link lever 103 is provided with a pin hole 132. The outer end refers to the end that is away from the cam 106. Correspondingly, an inner end refers to the end that is close to the cam 106. The inner end of the link lever 103 is provided with a chute 131. A cam shaft pin 113 passes through the chute 131 and is fastened on the cam 106. When the cam rotates, the cam shaft pin 113 moves in the chute 131. When the cam shaft pin 113 is positioned within the chute 131 and does not contact with any end of the chute 131, there is no interaction between the cam shaft pin 113 and the link lever 103. When the cam shaft pin 113 moves to contact with an end of the chute 131, the cam 106 drives the link lever 103 to move through the cam shaft pin 113. The link lever 103 is pushed or pulled by the cam shaft pin 113 driven by the cam 106. The link lever 103 is provided with a roller 104, the roller 104 is mounted between the pin hole 132 and the chute 131. As shown in FIG. 7, the roller 104 is assembled on the link lever 103 through a roller pin 102. The roller 104 facilitates the linkage of the cam 106 and the link lever 103.

The fan-shaped lever 105 is mounted on the two side plates 115 via a main shaft 107 and an auxiliary shaft 114. The fan-shaped lever 105 is provided with a first chute 151. According to the first embodiment, the fan-shaped lever 105 comprises two fan-shaped plates and a connection portion connecting the two fan-shaped plates, as shown in FIG. 2. The two fan-shaped plates are identical. Each fan-shaped plate is positioned close to a side plate 115 respectively, wherein one fan-shaped plate is rotatably mounted on one side plate through the main shaft 107 while the other fan-shaped plate is rotatably mounted on the other side plate through the auxiliary shaft 114. The bottom of each fan-shaped plate is provided with a fan-shaped expansion area, and the first chute 151 is provided in the fan-shaped expansion area. The fan-shaped lever 105 will follow the cam 106 to rotate under the function of the thrust shaft pin 111. The rotation of the fan-shaped lever 105 will cause the main shaft 107 and the auxiliary shaft 114 to rotate accordingly. With the auxiliary shaft 114 and the lever 105, unbalanced bearing of the thrust shaft pin 111 during a movement may be avoided.

The bottom of the spring mechanism is rotatably mounted on the side plate and the top of the spring mechanism is provided with a hole. According to the first embodiment, the spring mechanism comprises a spring guide rod 110, an upper bracket 191, a lower bracket 192 and a spring 112. The bottom of the spring guide rod 110 is provided with a hole and the spring guide rod 110 is rotatably mounted on the side plate 115, the top of the spring guide rod 110 is provided with a chute. The upper bracket 191 is mounted in the chute on the top of the spring guide rod 110 and the upper bracket 191 can move up and down in the chute. The top of the upper bracket 191 is provided with a hole for the thrust shaft pin 111 to pass through. The lower bracket 192 is mounted on the bottom of the spring guide rod 110. The spring 112 is installed on the spring guide rod 110 and between the upper bracket 191 and the lower bracket 192. The upper bracket 191 moves down along the chute on the top of the spring guide rod 110, the spring 112 is compressed and stores energy. When the spring 112 releases energy, the spring force will jack up the upper bracket 191.

The thrust shaft pin 111 passes through second chutes 501 on two side plates 115, the first chute 151 on the fan-shaped lever 105, the hole on the top of the spring mechanism, and the pin hole 132 on the outer end of the link lever 103. The thrust shaft pin 111 makes linkage of the link lever 103, the fan-shaped lever 105 and the spring mechanism. The shape of the second chute 501 matches with the sliding track of the thrust shaft pin 111. The thrust shaft pin 111 is supported by the second chute 501 during a movement, so that the movement of the thrust shaft pin 111 is stabilized.

When the cam 106 rotates, the cam 106 drives the thrust shaft pin 111 to move via the link lever 103. The thrust shaft pin 111 is positioned in the first chute 151 of the fan-shaped lever 105. The movement of the thrust shaft pin 111 will push the upper bracket 191 to move down and compress the spring 112 to store energy. In an energy storing phase of the spring mechanism, the thrust shaft pin 111 moves in the first chute 151 of the fan-shaped lever 105 and does not contact with any end of the first chute 151. There is no interaction between the thrust shaft pin 111 and the fan-shaped lever 105, the fan-shaped lever 105 remains stationary and a contact 108 remains stationary. In an energy releasing phase of the spring mechanism, the spring 112 jacks up and causes the upper bracket 191 to move up. The thrust shaft pin 111 moves to an end of the first chute 151 and interacts with the fan-shaped lever 105. The fan-shaped lever 105 rotates and drives the contact 108 to move via the main shaft 107.

Generally speaking, a working procedure of the motor cam operating mechanism is as follows:

When operating a common side power supply, the rotation range of the cam is biased towards the reserve side (the right side shown in the figures). During a closing procedure, the cam rotates counterclockwise and drives the fan-shaped lever through the link lever. The fan-shaped lever to rotate from a position deviated outwards from the vertical position to the vertical position, and further to a position deviated inwards from the vertical position, so as to perform an energy storing procedure and an energy releasing procedure. During an opening procedure, the cam rotates clockwise and drives the fan-shaped lever through the link lever. The fan-shaped lever to rotate from a position deviated inwards from the vertical position to the vertical position, and further to a position deviated outwards from the vertical position, so as to perform an energy storing procedure and an energy releasing procedure.

When operating a reserve side power supply, the rotation range of the cam is biased towards the common side (the left side shown in the figures). During a closing procedure, the cam rotates clockwise and drives the fan-shaped lever through the link lever. The fan-shaped lever to rotate from a position deviated outwards from the vertical position to the vertical position, and further to a position deviated inwards from the vertical position, so as to perform an energy storing procedure and an energy releasing procedure. During an opening procedure, the cam rotates counterclockwise and drives the fan-shaped lever through the link lever. The fan-shaped lever to rotate from a position deviated inwards from the vertical position to the vertical position, and further to a position deviated outwards from the vertical position, so as to perform an energy storing procedure and an energy releasing procedure.

FIG. 3 to FIG. 6 illustrate a working procedure of the motor cam operating mechanism according to the first embodiment, the common side is shown as an example.

Figure 3:
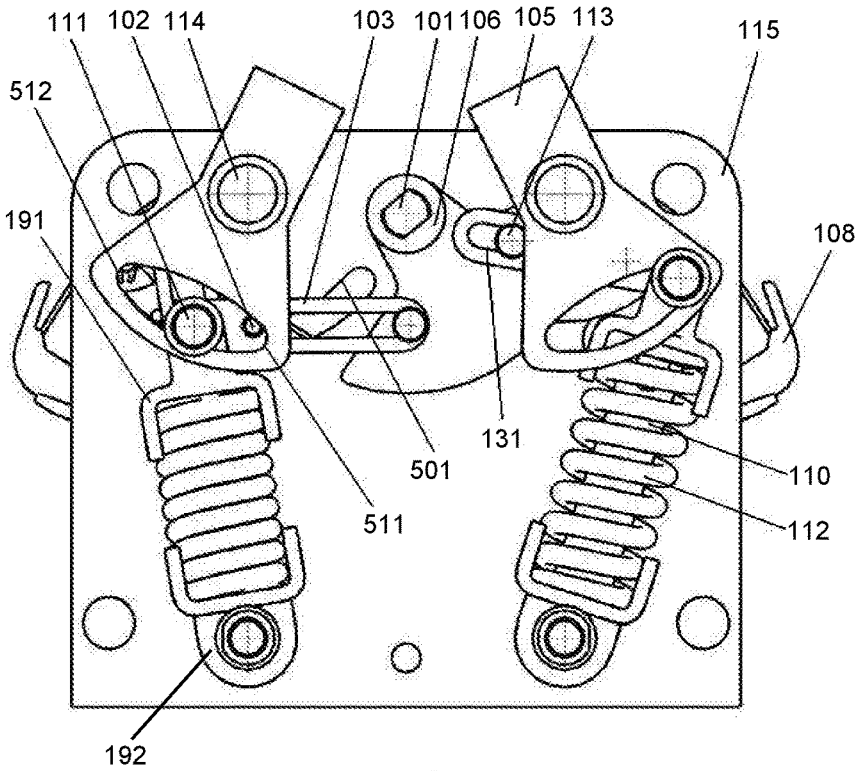
FIG. 3 illustrates a schematic view of a motor cam operating mechanism according to a first embodiment of the present invention, while a common side contact is closing and a spring is storing energy.

FIG. 3 illustrates a schematic view of a motor cam operating mechanism according to a first embodiment of the present invention, while a common side contact is closing and a spring is storing energy. During an energy storing phase of the spring when the common side contact is closing, the motor 101 drives the cam 106 to rotate counterclockwise. The cam shaft pin 113 passes through the link lever 103 and is fastened on the cam 106. When the cam 106 rotates, the cam 106 drives the link lever 103 to move via the cam shaft pin 113. The link lever 103 pulls the thrust shaft pin 111 and then pushes down the upper bracket 191. The spring 112 is compressed and passes through a dead point. During a compressing phase of the spring 112, the thrust shaft pin 111 slides in the second chute 501 of the side plate 115. The thrust shaft pin 111 does not contact with a first working surface 511 in the first chute 151 of the fan-shaped lever 105. The contact 108 remains stationary during this phase. For the reserve transmission mechanism, during this phase, the cam shaft pin 113 of the cam 106 is in idle motion within a chute 131 in the link lever 103, which means the cam shaft pin 113 does not contact with any end of the chute 131 (referring to the components of the reserve transmission mechanism). Therefore, the thrust shaft pin 111 (of the reserve transmission mechanism) remains stationary and the reserve side contact remains stationary as well.

Figure 4:
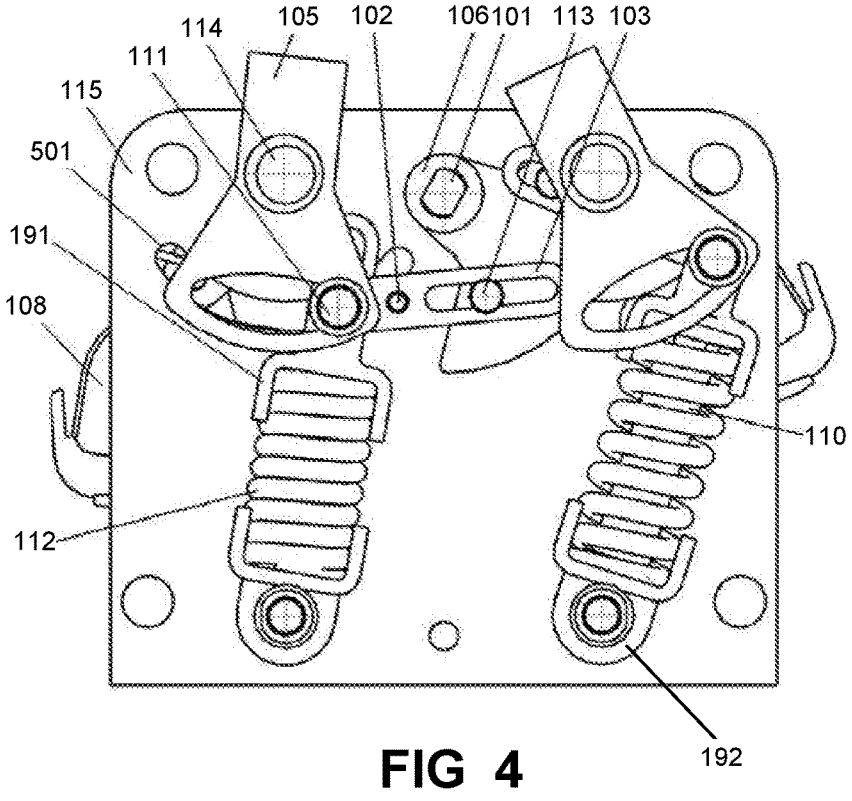
FIG. 4 illustrates a schematic view of a motor cam operating mechanism according to a first embodiment of the present invention, while a common side contact is closing and a spring is releasing energy.

FIG. 4 illustrates a schematic view of a motor cam operating mechanism according to a first embodiment of the present invention, while a common side contact is closing and a spring is releasing energy. During an energy releasing phase of the spring 112 when the common side contact is closing, the thrust shaft pin 111 contacts with the first working surface 511 in the first chute 151 of the fan-shaped lever 105. The thrust shaft pin 111 drives the fan-shaped lever 105 to rotate, then the auxiliary shaft 114 and the main shaft 107 rotate to bring the contact 108 to close. After the contact is closed, the roller 104 contacts with the outline of the cam 106.

Figure 5:
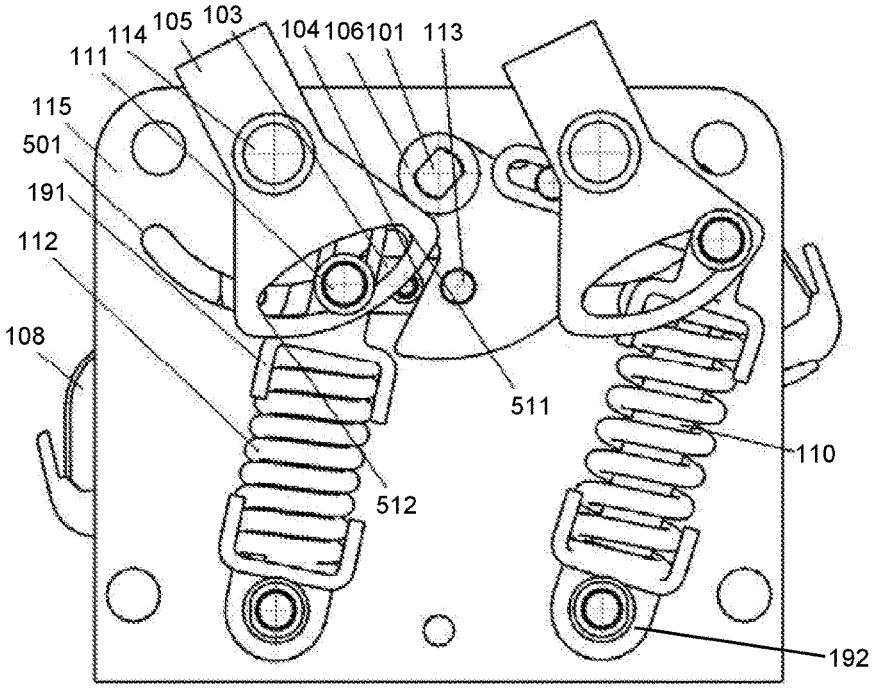
FIG. 5 illustrates a schematic view of a motor cam operating mechanism according to a first embodiment of the present invention, while a common side contact is opening and a spring is storing energy.

FIG. 5 illustrates a schematic view of a motor cam operating mechanism according to a first embodiment of the present invention, while a common side contact is opening and a spring is storing energy. The output shaft of the motor 101 drives the cam 106 to rotate clockwise. The cam 106 pushes the roller 104 and the roller 104 drives the link lever 103 to move so as to compress the spring 112. The spring 112 is compressed and passes through a dead point. During a compressing phase of the spring 112, the thrust shaft pin 111 slides in the second chute 501 of the side plate 115 and does not contact with a second working surface 512 in the first chute 151 of the fan-shaped lever 105. The second working surface 512 and the first working surface 511 are positioned on different ends of the first chute 151 respectively. The contact 108 remains closed during this phase. In FIG. 5, for the purpose of showing the roller 104, a part of the common side link lever is hidden.

Figure 6:
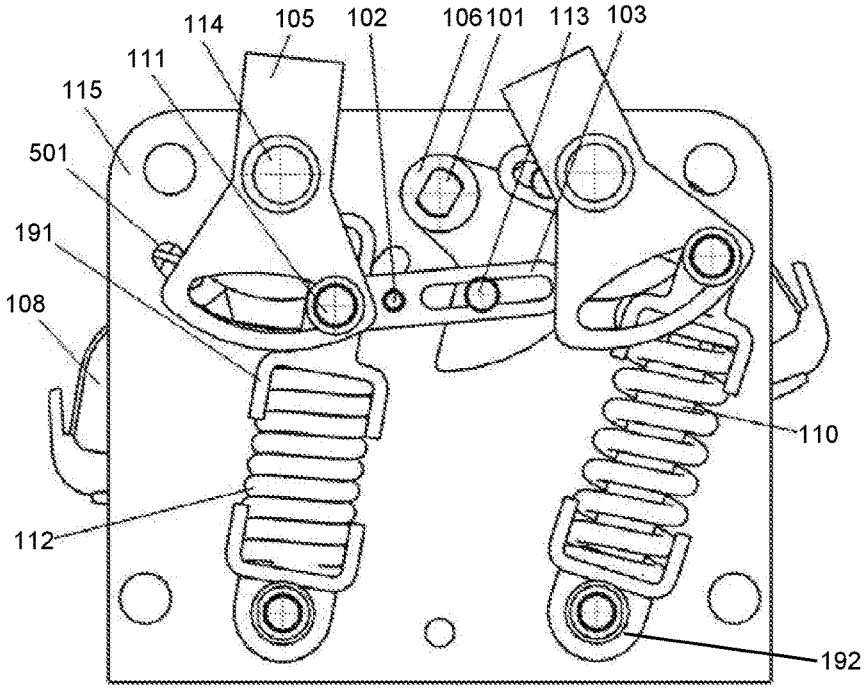
FIG. 6 illustrates a schematic view of a motor cam operating mechanism according to a first embodiment of the present invention, while a common side contact is opening and a spring is releasing energy.

FIG. 6 illustrates a schematic view of a motor cam operating mechanism according to a first embodiment of the present invention, while a common side contact is opening and a spring is releasing energy. When the common side contact is opening, during an energy releasing phase of the spring 112, the thrust shaft pin 111 contacts with the second working surface 512 in the first chute 151 of the fan-shaped lever 105. Then the fan-shaped lever 105, the auxiliary shaft 114 and the main shaft 107 rotate and bring the contact 108 to open.

The side plate 115 provides support to bear the thrust shaft pin 111 in the second chute 501 of the side plate 115 during the whole movement. In the energy releasing phase of the spring 112, that is, the moving phase of the contact 108, the thrust shat pin 111 contacts with the first working surface 511 or the second working surface 512 of the fan-shaped lever 105 so as to bring the contact 108 to move.

The closing and opening procedure of the reserve side transmission mechanism are similar to that of the common side and will not be described in detail.

FIG. 7 illustrates a schematic view of installation of a cam and a link lever in a motor cam operating mechanism according to a first embodiment of the present invention. The cam 106 comprises a shaft portion 161 and a fan-shaped portion 162. The shaft portion 161 is provided with a shaft hole, the output shaft of the motor 101 is installed in the shaft hole. The cam shaft pin 113 is fastened on the fan-shaped portion 162. The roller 104 is assembled on the link lever through a roller pin 102. The roller pin 102 passes through the link lever 103 and the roller 104, the other end of the roller pin 102 is riveted to the link lever 103. The roller 104 is able to rotate freely about the roller pin 102.

Figure 8:
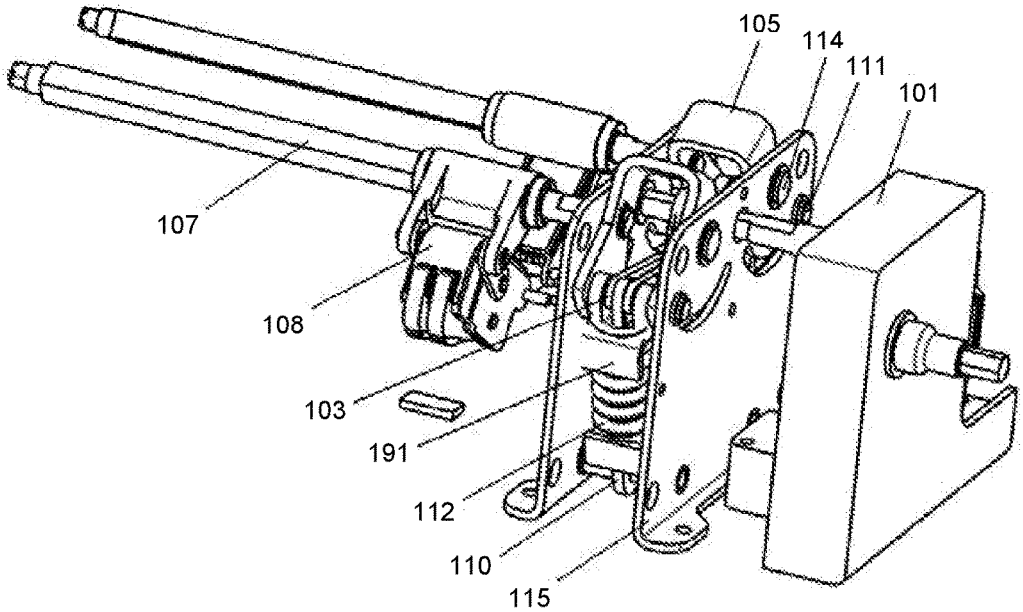
FIG. 8 illustrates a schematic view of installation of a contact and a motor cam operating mechanism according to a first embodiment of the present invention.

FIG. 8 illustrates a schematic view of installation of a contact and a motor cam operating mechanism according to a first embodiment of the present invention.

Referring to FIG. 9 to FIG. 14, a motor cam operating mechanism according to a second embodiment of the present invention is disclosed.

Figure 9:
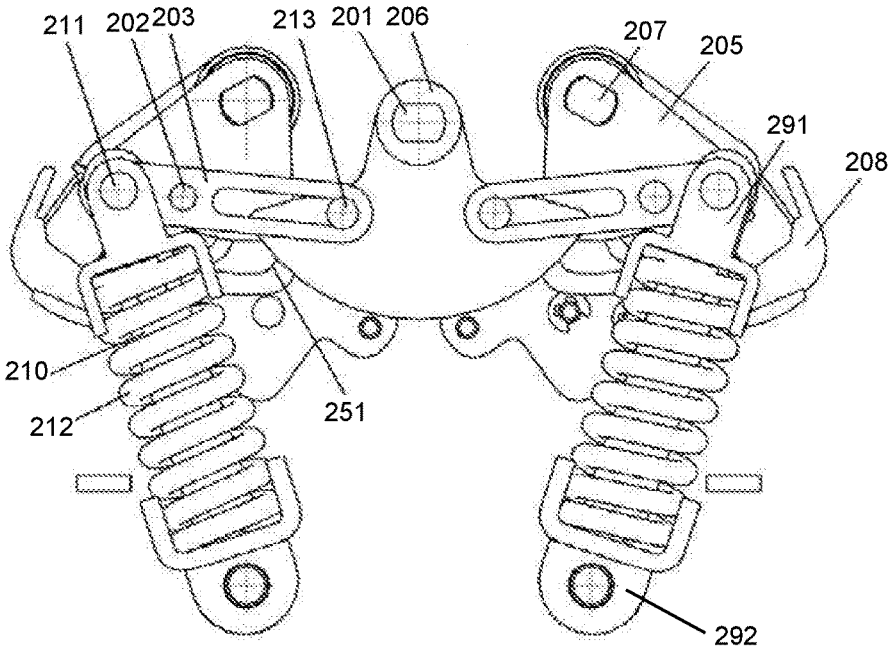
FIG. 9 illustrates a front view of a motor cam operating mechanism according to a second embodiment of the present invention.

FIG. 9 illustrates a front view of a motor cam operating mechanism according to a second embodiment of the present invention. Compared with the first embodiment, the structure of the fan-shaped lever in the motor cam operating mechanism according to the second embodiment is different. As shown in the figures, the motor cam operating mechanism comprises a cam 206, a common side transmission mechanism and a reserve side transmission mechanism. The common side transmission mechanism and the reserve side transmission mechanism have a same structure. The common side transmission mechanism and the reserve side transmission mechanism are arranged on both sides of the cam 206 in a symmetrical manner. The cam 206 is mounted on an output shaft 201 of a motor. The motor drives the cam 206 to rotate clockwise or counterclockwise. According to the embodiment shown in the figures, the cam 206 rotates counterclockwise from a middle position and then the cam 206 deviates towards the reserve side, the cam 206 rotates clockwise from a middle position and the cam 206 deviates towards the common side. Generally, the rotation range of the cam 206 will be limited in one side of the middle position. For example, the cam 206 rotates counterclockwise from the middle position to the most right position shown in the figures to perform a common side closing operation. The cam 206 rotates clockwise from the most right position shown in the figures to the middle position to perform a common side opening operation. Similarly, the cam 206 rotates counterclockwise from the middle position to the most left position shown in the figures to perform a reserve side closing operation. The cam 206 rotates clockwise from the most left position shown in the figures to the middle position to perform a reserve side opening operation. The cam 206 has the same structure with the cam of the first embodiment, the structure of the cam 206 may refer to FIG. 7 as well.

As shown in FIG. 9, the common side transmission mechanism and the reserve side transmission mechanism has a same structure and are arranged symmetrically. The transmission mechanism is arranged on one side of the cam. The transmission mechanism comprises a link lever 203, a fan-shaped lever 205, a spring mechanism and a thrust shaft pin 211.

An outer end of the link lever 203 is provided with a pin hole 232. The outer end refers to the end that is away from the cam 206. Correspondingly, an inner end refers to the end that is close to the cam 206. The inner end of the link lever 203 is provided with a chute 231. A cam shaft pin 213 passes through the chute 231 and is fastened on the cam 206. When the cam rotates, the cam shaft pin 213 moves in the chute 231. When the cam shaft pin 213 is positioned within the chute 231 and does not contact with any end of the chute 231, there is no interaction between the cam shaft pin 213 and the link lever 203. When the cam shaft pin 213 moves to contact with an end of the chute 231, the cam 206 drives the link lever 203 to move through the cam shaft pin 213. The link lever 203 is pushed or pulled by the cam shaft pin 213 driven by the cam 206. The link lever 203 is provided with a roller 204, the roller 204 is mounted between the pin hole 232 and the chute 231. The roller 204 is assembled on the link lever 203 through a roller pin 202. The roller 204 facilitates the linkage of the cam 206 and the link lever 203.

The fan-shaped lever 205 is rotatably mounted on the main shaft 207. The fan-shaped lever 205 is provided with a first chute 251. According to the second embodiment, the fan-shaped lever 205 only has a single plate and the single plate fan-shaped lever 205 is mounted on the main shaft 207. The second embodiment is different from the first embodiment on this point, the fan-shaped lever according to the second embodiment is mounted on the main shaft rather than the side plate. Therefore, the auxiliary shaft is not necessary. It is not necessary to use the two-plates fan-shaped lever as the first embodiment as well. The bottom of the fan-shaped lever 205 is provided with a fan-shaped expansion area, and the first chute 251 is provided in the fan-shaped expansion area.

The bottom of the spring mechanism is rotatably mounted on a rotation shaft and the top of the spring mechanism is provided with a hole. According to the second embodiment, the spring mechanism comprises a spring guide rod 210, an upper bracket 291, a lower bracket 292 and a spring 212. The bottom of the spring guide rod 210 is provided with a hole and the spring guide rod 210 is rotatably mounted on the rotation shaft, the top of the spring guide rod 210 is provided with a chute. The upper bracket 291 is mounted in the chute on the top of the spring guide rod 210 and the upper bracket 291 can move up and down in the chute. The top of the upper bracket 291 is provided with a hole for the thrust shaft pin 211 to pass through. The lower bracket 292 is mounted on the bottom of the spring guide rod 210. The spring 212 is installed on the spring guide rod 210 and between the upper bracket 291 and the lower bracket 292. The upper bracket 291 moves down along the chute on the top of the spring guide rod 210, the spring 212 is compressed and stores energy. When the spring 212 releases energy, the spring force will jack up the upper bracket 291.

The thrust shaft pin 211 passes through the first chute 251 on the fan-shaped lever 205, the hole on the top of the spring mechanism, and the pin hole 232 on the outer end of the link lever 203. The thrust shaft pin 211 makes linkage of the link lever 203, the fan-shaped lever 205 and the spring mechanism.

The fan-shaped lever 205 follows the link lever 203 to rotate, driven by the cam 206. The thrust shaft pin 211 is positioned in the first chute 251 of the fan-shaped lever 205. When the cam 206 rotates, the cam 206 drives the thrust shaft pin 211 to move via the link lever 203. The thrust shaft pin 211 is positioned in the first chute 251 of the fan-shaped lever 205. The movement of the thrust shaft pin 211 will push the upper bracket 291 to move down and compress the spring 212 to store energy. In an energy storing phase of the spring mechanism, the thrust shaft pin 211 moves in the first chute 251 of the fan-shaped lever 205 and does not contact with any end of the first chute 251. There is no interaction between the thrust shaft pin 211 and the fan-shaped lever 205, the fan-shaped lever 205 remains stationary and a contact 208 remains stationary. In an energy releasing phase of the spring mechanism, the spring 212 jacks up and causes the upper bracket 291 to move up. The thrust shaft pin 211 moves to an end of the first chute 251 and interacts with the fan-shaped lever 205. The fan-shaped lever 205 rotates and drives the contact 208 to move via the main shaft 207.

FIG. 10 to FIG. 13 illustrate a working procedure of the motor cam operating mechanism according to the second embodiment, the common side is shown as an example.

Figure 10:
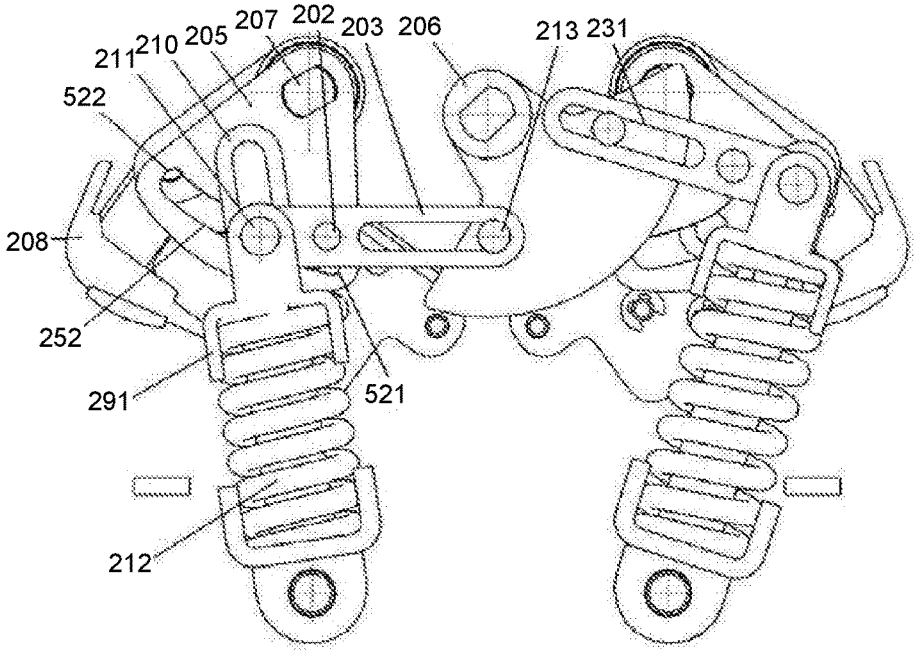
FIG. 10 illustrates a schematic view of a motor cam operating mechanism according to a second embodiment of the present invention, while a common side contact is closing and a spring is storing energy.

FIG. 10 illustrates a schematic view of a motor cam operating mechanism according to a second embodiment of the present invention, while a common side contact is closing and a spring is storing energy. During an energy storing phase of the spring when the common side contact is closing, the motor 201 drives the cam 206 to rotate counterclockwise. The cam shaft pin 213 passes through the link lever 203 and is fastened on the cam 206. When the cam 206 rotates, the cam 206 drives the link lever 203 to move via the cam shaft pin 213. The link lever 203 pulls the thrust shaft pin 211 and then pushes down the upper bracket 291. The spring 212 is compressed and passes through a dead point. During a compressing phase of the spring 212, the thrust shaft pin 211 slides in the first chute 251 of the fan-shaped lever 205. The thrust shaft pin 211 does not contact with a first working surface 521 in the first chute 251 of the fan-shaped lever 205. The contact 208 remains stationary during this phase. For the reserve transmission mechanism, during this phase, the cam shaft pin 213 of the cam 206 is in idle motion within a chute 231 in the link lever 203, which means the cam shaft pin 213 does not contact with any end of the chute 231 (referring to the components of the reserve transmission mechanism). Therefore, the thrust shaft pin 211 (of the reserve transmission mechanism) remains stationary and the reserve side contact remains stationary as well.

Figure 11:
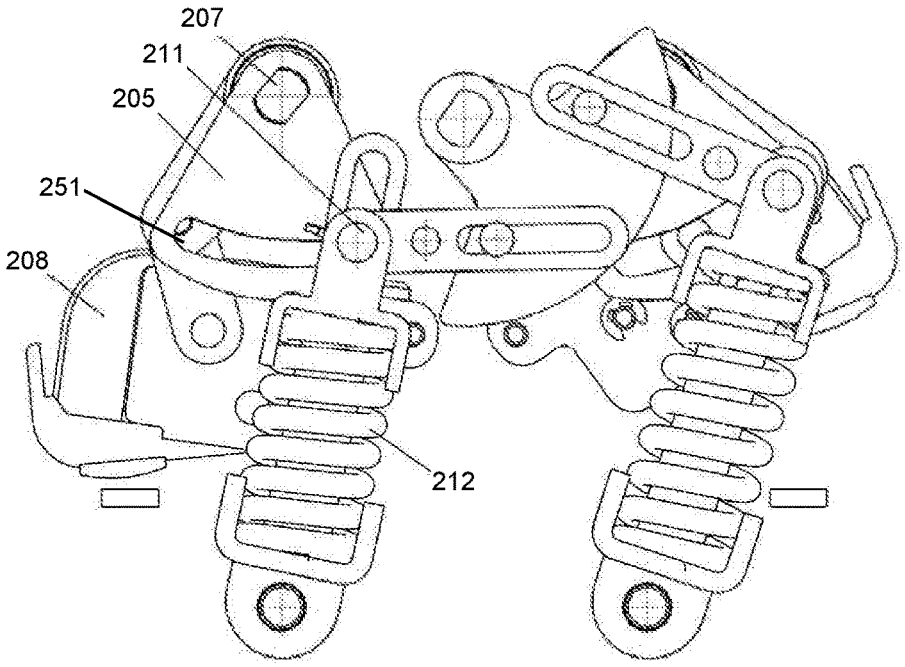
FIG. 11 illustrates a schematic view of a motor cam operating mechanism according to a second embodiment of the present invention, while a common side contact is closing and a spring is releasing energy.

FIG. 11 illustrates a schematic view of a motor cam operating mechanism according to a second embodiment of the present invention, while a common side contact is closing and a spring is releasing energy. During an energy releasing phase of the spring 212 when the common side contact is closing, the thrust shaft pin 211 contacts with the first working surface 521 in the first chute 251 of the fan-shaped lever 205. The thrust shaft pin 211 drives the fan-shaped lever 205 to rotate, then the main shaft 207 rotates to bring the contact 208 to close. After the contact is closed, the roller 204 contacts with the outline of the cam 206.

Figure 12:
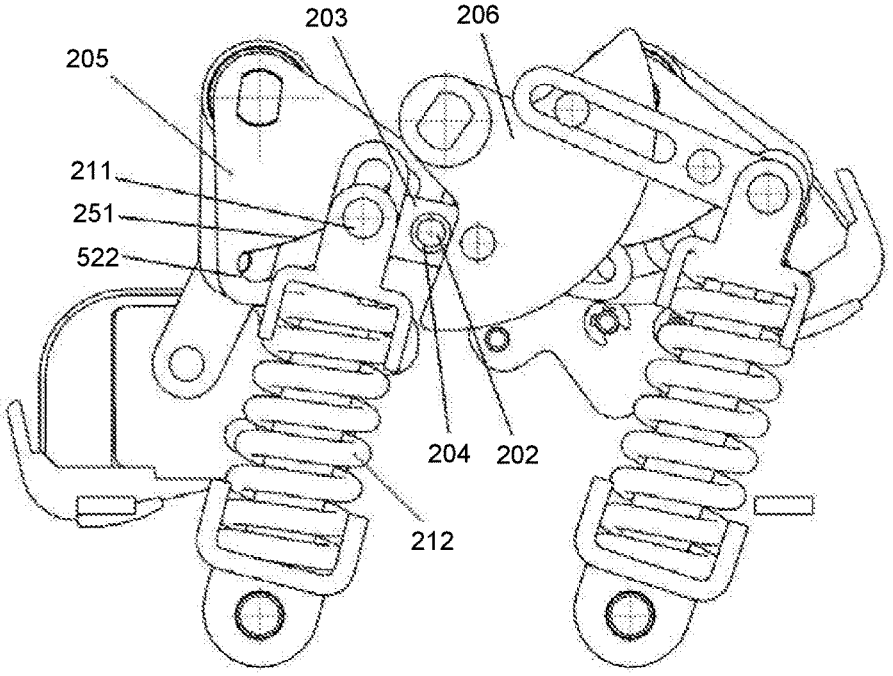
FIG. 12 illustrates a schematic view of a motor cam operating mechanism according to a second embodiment of the present invention, while a common side contact is opening and a spring is storing energy.

FIG. 12 illustrates a schematic view of a motor cam operating mechanism according to a second embodiment of the present invention, while a common side contact is opening and a spring is storing energy. The output shaft of the motor 201 drives the cam 206 to rotate clockwise. The cam 206 pushes the roller 204 and the roller 204 drives the link lever 203 to move so as to compress the spring 212. The spring 212 is compressed and passes through a dead point. During a compressing phase of the spring 212, the thrust shaft pin 211 slides in the first chute 251 of the fan-shaped lever 205. The thrust shaft pin 211 does not contact with a second working surface 522 in the first chute 251 of the fan-shaped lever 205. The second working surface 522 and the first working surface 521 are positioned on different ends of the first chute 251 respectively. The contact 208 remains closed during this phase. In FIG. 12, for the purpose of showing the roller 204, a part of the common side link lever is hidden.

Figure 13:
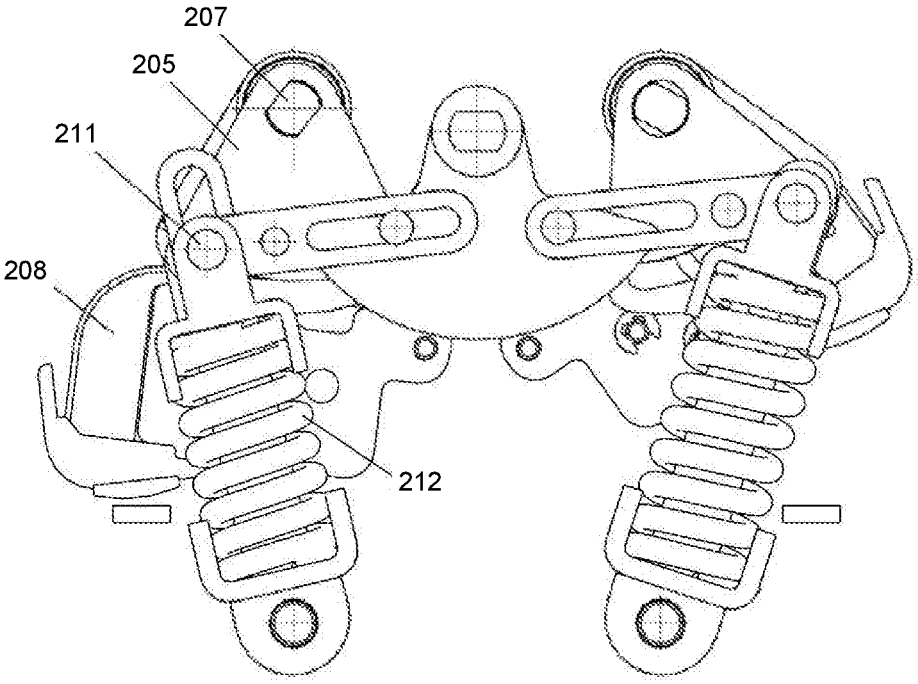
FIG. 13 illustrates a schematic view of a motor cam operating mechanism according to a second embodiment of the present invention, while a common side contact is opening and a spring is releasing energy.

FIG. 13 illustrates a schematic view of a motor cam operating mechanism according to a second embodiment of the present invention, while a common side contact is opening and a spring is releasing energy. When the common side contact is opening, during an energy releasing phase of the spring 212, the thrust shaft pin 211 contacts with the second working surface 522 in the first chute 251 of the fan-shaped lever 205. Then the fan-shaped lever 205 and the main shaft 207 rotates and bring the contact 208 to open. The closing and opening procedure of the reserve side transmission mechanism are similar to that of the common side.

The closing and opening procedure of the reserve side transmission mechanism are similar to that of the common side and will not be described in detail.

Figure 14:
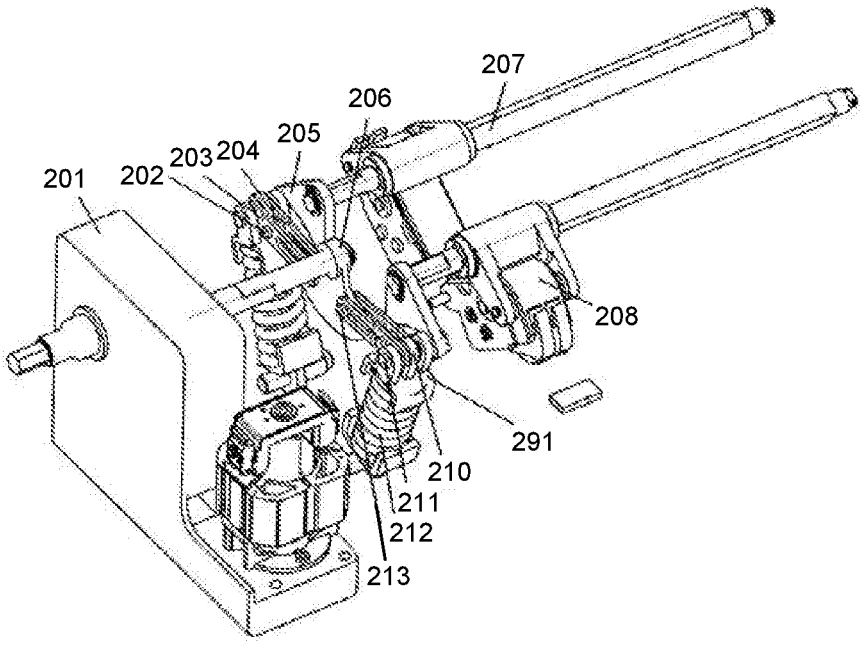
FIG. 14 illustrates a schematic view of installation of a contact and a motor cam operating mechanism according to a second embodiment of the present invention.

FIG. 14 illustrates a schematic view of installation of a contact and a motor cam operating mechanism according to a second embodiment of the present invention.

The present invention may realize a transmission between a common side power supply and a reserve side power supply of a switch electrical apparatus by a structure which is relatively simple and easy to manufacture. The mechanism is driven by a motor so that larger contact pressure may be provided and better reliability on mechanical transmission is ensured.

The above embodiments are provided to those skilled in the art to realize or use the invention, under the condition that various modifications or changes being made by those skilled in the art without departing the spirit and principle of the invention, the above embodiments may be modified and changed variously, therefore the protection scope of the invention is not limited by the above embodiments, rather, it should conform to the maximum scope of the innovative features mentioned in the Claims.

What is claimed is:

1. A transmission mechanism of a motor cam operating mechanism, wherein the transmission mechanism is in coordination with a cam driven by a motor and is arranged on one side of the cam, the transmission mechanism and the cam are both mounted between two side plates, the transmission mechanism comprising:

a link lever, an outer end of the link lever is provided with a pin hole and an inner end of the link lever is provided with a chute; a cam shaft pin passes through the chute and is fastened on the cam; when the cam rotates, the cam shaft pin moves in the chute, when the cam shaft pin contacts with an end of the chute, the cam drives the link lever to move through the cam shaft pin; a roller is mounted between the pin hole and the chute;

a fan-shaped lever, the fan-shaped lever is mounted on the two side plates via a main shaft and an auxiliary shaft, the fan-shaped lever is provided with a first chute;

a spring mechanism, the bottom of the spring mechanism is rotatably mounted on the two side plates and the top of the spring mechanism is provided with a hole;

a thrust shaft pin, the thrust shaft pin passes through second chutes on the two side plates, the first chute on the fan-shaped lever, the hole on the top of the spring mechanism, and the pin hole on the outer end of the link lever, the thrust shaft pin makes linkage of the link lever, the fan-shaped lever and the spring mechanism;

when the cam rotates, the cam drives the thrust shaft pin to compress the spring mechanism via the link lever so that the spring mechanism stores energy; in an energy storing phase of the spring mechanism, the thrust shaft pin moves in the first chute of the fan-shaped lever, there is no interaction between the thrust shaft pin and the fan-shaped lever, the fan-shaped lever remains stationary and a contact that is mounted on the main shaft remains stationary; in an energy releasing phase of the spring mechanism, the thrust shaft pin moves to an end of the first chute and interacts with the fan-shaped lever, the fan-shaped lever rotates and drives the contact to move via the main shaft.

2. The transmission mechanism of a motor cam operating mechanism according to claim 1, wherein the spring mechanism comprises a spring guide rod, an upper bracket a lower bracket and a spring;

the bottom of the spring guide rod is provided with a hole and the spring guide rod is rotatably mounted on the two side plates, the top of the spring guide rod is provided with a chute;

the upper bracket is mounted in the chute on the top of the spring guide rod and moves in the chute on the top of the spring guide rod, the top of the upper bracket is provided with a hole for the thrust shaft pin to pass through;

the lower bracket is mounted on the bottom of the spring guide rod;

the spring is installed on the spring guide rod and between the upper bracket and the lower bracket.

3. The transmission mechanism of a motor cam operating mechanism according to claim 1, wherein the fan-shaped lever comprises two fan-shaped plates and a connection portion connecting the two fan-shaped plates, the two fan-shaped plates are identical, each fan-shaped plate is positioned close to at least one of the two side plates respectively, wherein one fan-shaped plate is rotatably mounted on one of the two side plates through the main shaft while the other fan-shaped plate is rotatably mounted on the other of the two side plates through the auxiliary shaft;

the bottom of each fan-shaped plate is provided with a fan-shaped expansion area, and the first chute is provided in the fan-shaped expansion area.

4. A motor cam operating mechanism comprising the cam, a common side transmission mechanism and a reserve side transmission mechanism; the cam, the common side transmission mechanism and the reserve side transmission mechanism are mounted between the two side plates; the common side transmission mechanism and the reserve side mechanism are the transmission mechanism according to claim 1, the common side transmission mechanism and the reserve side transmission mechanism are arranged on both sides of the cam in a symmetrical manner;

the cam is mounted on an output shaft of a motor, the motor drives the cam to rotate clockwise or counter-clockwise;

when operating a common side power supply, the rotation range of the cam is biased towards a reserve side; during a closing procedure, the cam drives the fan-shaped lever through the link lever and cause the fan-shaped lever to rotate from a position deviated outwards from the vertical position to the vertical position, and further to a position deviated inwards from the vertical position, so as to perform an energy storing procedure and an energy releasing procedure; during an opening procedure, the cam drives the fan-shaped lever through the link lever and cause the fan-shaped lever to rotate from a position deviated inwards from the vertical position to the vertical position, and further to a position deviated outwards from the vertical position, so as to perform an energy storing procedure and an energy releasing procedure;

when operating a reserve side power supply, the rotation range of the cam is biased towards a common side; during a closing procedure, the cam drives the fan-shaped lever through the link lever and cause the fan-shaped lever to rotate from a position deviated outwards from the vertical position to the vertical position, and further to a position deviated inwards from the vertical position, so as to perform an energy storing procedure and an energy releasing procedure; during an opening procedure, the cam drives the fan-shaped lever through the link lever and cause the fan-shaped lever to rotate from a position deviated inwards from the vertical position to the vertical position, and further to a position deviated outwards from the vertical position, so as to perform an energy storing procedure and an energy releasing procedure.

5. The motor cam operating mechanism according to claim 4, wherein the cam comprises a shaft portion and a fan-shaped portion, the shaft portion is provided with a shaft hole, the output shaft of the motor is installed in the shaft hole, the cam shaft pin is fastened on the fan-shaped portion;

the roller is assembled on the link lever through a roller pin.

6. A transmission mechanism of a motor cam operating mechanism, wherein the transmission mechanism is in coordination with a cam driven by a motor and is arranged on one side of the cam, the transmission mechanism comprising:

a link lever, an outer end of the link lever is provided with a pin hole and an inner end of the link lever is provided with a chute; a cam shaft pin passes through the chute and is fastened on the cam; when the cam rotates, the cam shaft pin moves in the chute, when the cam shaft pin contacts with an end of the chute, the cam drives the link lever to move through the cam shaft pin; a roller is mounted between the pin hole and the chute;

a fan-shaped lever, the fan-shaped lever is rotatably mounted on a main shaft, the fan-shaped lever is provided with a first chute;

a spring mechanism, the bottom of the spring mechanism is rotatably mounted on a rotation shaft and the top of the spring mechanism is provided with a hole;

a thrust shaft pin, the thrust shaft pin passes through the first chute on the fan-shaped lever, the hole on the top of the spring mechanism, and the pin hole on the outer end of the link lever, the thrust shaft pin makes linkage of the link lever, the fan-shaped lever and the spring mechanism;

when the cam rotates, the cam drives the thrust shaft pin to compress the spring mechanism via the link lever so that the spring mechanism stores energy; in an energy storing phase of the spring mechanism, the thrust shaft pin moves in the first chute of the fan-shaped lever, there is no interaction between the thrust shaft pin and the fan-shaped lever, the fan-shaped lever remains stationary and a contact that is mounted on the main shaft remains stationary; in an energy releasing phase of the spring mechanism, the thrust shaft pin moves to an end of the first chute and interacts with the fan-shaped lever, the fan-shaped lever rotates and drives the contact to move via the main shaft.

7. The transmission mechanism of a motor cam operating mechanism according to claim 6, wherein the spring mechanism comprises a spring guide rod, an upper bracket a lower bracket and a spring;

the bottom of the spring guide rod is rotatably mounted on a shaft, the top of the spring guide rod is provided with a chute;

the upper bracket is mounted in the chute on the top of the spring guide rod and moves in the chute on the top of the spring guide rod, the top of the upper bracket is provided with a hole for the thrust shaft pin to pass through;

the lower bracket is mounted on the bottom of the spring guide rod;

the spring is installed on the spring guide rod and between the upper bracket and the lower bracket.

8. The transmission mechanism of a motor cam operating mechanism according to claim 6, wherein the bottom of each fan-shaped plate is provided with a fan-shaped expansion area, and the first chute is provided in the fan-shaped expansion area.

9. A motor cam operating mechanism comprising the cam, a common side transmission mechanism and a reserve side transmission mechanism; the common side transmission mechanism and the reserve side mechanism are the transmission mechanism according to claim 6, the common side transmission mechanism and the reserve side transmission mechanism are arranged on both sides of the cam in a symmetrical manner;

the cam is mounted on an output shaft of a motor, the motor drives the cam to rotate clockwise or counter-clockwise;

when operating a common side power supply, the rotation range of the cam is biased towards a reserve side; during a closing procedure, the cam drives the fan-shaped lever through the link lever and cause the fan-shaped lever to rotate from a position deviated outwards from the vertical position to the vertical position, and further to a position deviated inwards from the vertical position, so as to perform an energy storing procedure and an energy releasing procedure; during an opening procedure, the cam drives the fan-shaped lever through the link lever and cause the fan-shaped lever to rotate from a position deviated inwards from the vertical position to the vertical position, and further to a position deviated outwards from the vertical position, so as to perform an energy storing procedure and an energy releasing procedure;

when operating a reserve side power supply, the rotation range of the cam is biased towards a common side; during a closing procedure, the cam drives the fan-shaped lever through the link lever and cause the fan-shaped lever to rotate from a position deviated outwards from the vertical position to the vertical position, and further to a position deviated inwards from the vertical position, so as to perform an energy storing procedure and an energy releasing procedure; during an opening procedure, the cam drives the fan-shaped lever through the link lever and cause the fan-shaped lever to rotate from a position deviated inwards from the vertical position to the vertical position, and further to a position deviated outwards from the vertical position, so as to perform an energy storing procedure and an energy releasing procedure.

10. The motor cam operating mechanism according to claim 9, wherein the cam comprises a shaft portion and a fan-shaped portion, the shaft portion is provided with a shaft hole, the output shaft of the motor is installed in the shaft hole, the cam shaft pin is fastened on the fan-shaped portion;

the roller is assembled on the link lever through a roller pin.

* * * * *